US008936165B2

(12) United States Patent
Trisler

(10) Patent No.: US 8,936,165 B2
(45) Date of Patent: Jan. 20, 2015

(54) APPARATUS FOR STORING LENGTHS OF PIPE

(76) Inventor: James Trisler, Zapata, TX (US)

( * ) Notice: Subject to any disclaimer, the term of this patent is extended or adjusted under 35 U.S.C. 154(b) by 843 days.

(21) Appl. No.: 12/952,718

(22) Filed: Nov. 23, 2010

(65) Prior Publication Data

US 2011/0062097 A1 Mar. 17, 2011

Related U.S. Application Data

(63) Continuation of application No. 11/385,715, filed on Mar. 22, 2006, now Pat. No. 7,850,016.

(60) Provisional application No. 60/664,293, filed on Mar. 23, 2005.

(51) Int. Cl.
*E21B 19/15* (2006.01)
*F16M 13/00* (2006.01)

(52) U.S. Cl.
CPC ..... *E21B 19/15* (2013.01)
USPC ..... 211/70.4; 248/346.06

(58) Field of Classification Search
CPC ..... E21B 19/15; F16M 2200/08
USPC ..... 211/70.4, 60.1; 248/346.01, 346.02, 248/346.03, 346.06; 410/42, 32, 36
See application file for complete search history.

(56) References Cited

U.S. PATENT DOCUMENTS

| | | | | | |
|---|---|---|---|---|---|
| 1,947,553 | A | * | 2/1934 | Johnston | 211/70.4 |
| 2,619,234 | A | * | 11/1952 | Stone | 211/70.4 |
| 4,190,165 | A | * | 2/1980 | Collins | 211/60.1 |
| 4,533,055 | A | | 8/1985 | Haney | |
| 4,729,537 | A | * | 3/1988 | Turner et al. | 248/547 |
| 5,082,128 | A | * | 1/1992 | Franzen et al. | 212/347 |
| 5,888,039 | A | * | 3/1999 | Cooley | 410/50 |

* cited by examiner

*Primary Examiner* — Michael Safavi
(74) *Attorney, Agent, or Firm* — Browdy and Neimark, PLLC

(57) ABSTRACT

A device for supporting a group of pipes during temporary storage, the device being composed of: an elongated pipe supporting element having a pipe supporting surface; and at least one safety stop assembly including a pipe stop member and at least one fastening element, wherein the pipe stop member is movable relative to the pipe supporting element between a stop position and a withdrawn position, the stop member, when in the stop position, resting on the pipe supporting element and being operative to prevent removal of pipes from the pipe supporting element, and the stop member being operative, when in the withdrawn position, to allow removal of pipes from the pipe supporting element, and the at least one fastening element being connectable between the pipe supporting element and the pipe stop member for holding the pipe stop member in the stop position.

12 Claims, 4 Drawing Sheets

APPARATUS FOR STORING LENGTHS OF PIPE

CROSS REFERENCE TO RELATED APPLICATION

This application is a continuation of U.S. application Ser. No. 11/385,715, filed on Mar. 22, 2006, the disclosure of which is incorporated herein by reference.

BACKGROUND OF THE INVENTION

The present invention relates to systems for storing lengths of pipe in industries such as oil and gas drilling.

Oil and gas drilling operations require the availability of a number of lengths of pipe that are added sequentially to pipe strings in order to drill a well. Heretofore, many arrangements have been used for temporary storage of the pipes prior to use. The known arrangements present a number of drawbacks. Among these are that they do not create safe conditions for operating personnel, are difficult to use, particularly when several layers of pipe are to be stored, and allow removal of individual lengths of pipe only with difficulty.

BRIEF SUMMARY OF THE INVENTION

The present invention provides a novel system that allows such pipes to be stored, even in several layers, and allows individual pipes to be removed, as needed, safely and easily.

According to the invention, pipe racks and strips for supporting additional layers of pipe are provided with novel and safe pipe stop devices that can easily be moved from a stop position to a retracted, or withdrawn, position, allowing removal of individual pipes. According to certain embodiments of the invention, movement from the stop position to the retracted position occurs in the direction away from a pipe in contact with the device, thereby facilitating operation of the device. According to other embodiments of the invention, the pipe stop is removed in order to permit removal of a length of pipe.

DETAILED DESCRIPTION OF THE INVENTION

Figure 1:
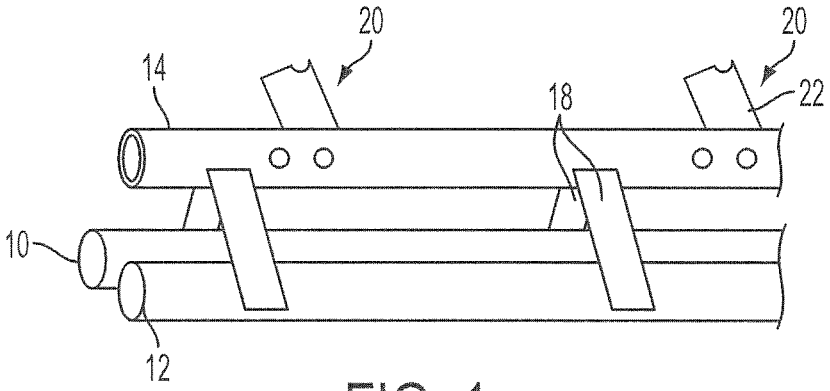
FIG. 1 is a perspective view of one end portion of a pipe rack according to the invention.
Figure 2:
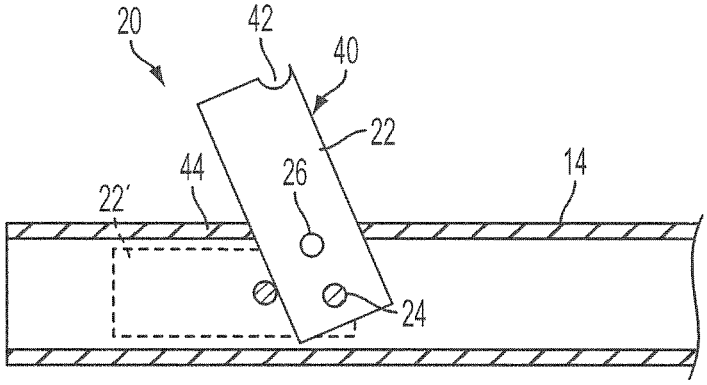
FIG. 2 is a detail, elevational cross-sectional view of a portion of one component of the pipe rack of FIG. 1.
Figure 3:
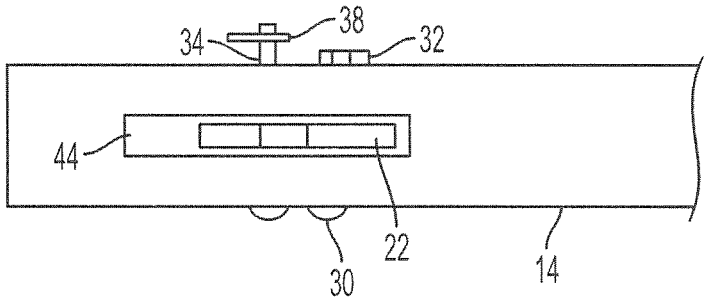
FIG. 3 is a top plan view of the portion shown in FIG. 2.

FIGS. 1, 2 and 3 show one end of a pipe rack provided with pipe stop elements according to one embodiment of the invention. The rack is composed of first and second tubular base elements 10 and 12 and an elongated pipe supporting element 14. At least element 14 is hollow, while base elements 10 and 12 may or may not be hollow. Element 14 is secured to elements 10 and 12 by supporting plates, or tubes, etc., 18, each welded to element 14 and to a respective one of elements 10 and 12 to provide a rigid structure. Connecting elements may also be welded between base elements 10 and 12 for added rigidity. Other forms of connection among elements 10, 12 and 14 can obviously be employed. For example, these could include triangular plates each vertex of which is connected to a respective tubular element.

While elements 10, 12 and 14 have been illustrated to have a circular cross-section, it will be appreciated that they can have other cross-sections, such as square or rectangular. Alternatively, these elements can be in the form of I-beams provided with safety stop assemblies along their sides.

Pipe supporting element 14 is provided with a plurality of safety stop assemblies 20 spaced apart along the length of element 14, preferably at regular intervals. For example, assemblies 20 may be spaced apart at intervals of 5 to 8 feet.

Referring to FIGS. 2 and 3 together with FIG. 1, each safety stop assembly 20 is composed of a pipe stop member 22, which may be in the form of a steel plate having a thickness of, for example, one-half inch. Plate 22 has two through openings 24 and 26. A pin 30 extends through aligned openings in tubular element 14 and opening 24 in member 22. Pin 30 may be threaded at its end to be secured to a nut 32 in order to hold pin 30 in place. Assembly 20 includes a further pin 34 that extends through other aligned openings in tubular element 14. Pin 34 is provided at one end with an enlarged head having a larger diameter than the openings in element 14 and at the other end with a small diameter through hole (not shown) for receiving a retaining pin 38 that may be in the form of a cotter pin. Pin 38 may be permanently secured to element 14 by a wire, or length of wire cable, to prevent it from being lost (as employed in the embodiment of FIGS. 6-8).

In FIGS. 2 and 3, stop member 22 is shown in its stop position, this being illustrated in solid lines in FIG. 2. Member 22 is held in this position by pin 34, bearing against one longitudinal edge of member 22. In this position, member 22 will prevent a pipe (not shown) that rests on the upper surface of element 14 and bears against stop surface 40 of element 22, from rolling off of the pipe rack.

When a pipe is to be removed from the rack, pin 38 is withdrawn from the hole in the end of pin 34 and pin 34 is then withdrawn in order to allow stop member 22 to pivot downwardly, away from the pipe, into the retracted position shown at 22' in FIG. 2. The pipe may then be guided off of the rack and removed for use. When member 22 is in the retracted position 22', pin 34 may be reinstalled, passing through opening 26, in order to hold member 22 in the retracted position and prevent pin 34 from being lost.

Preferably, one pipe stop assembly 20 can be installed at a distance of 6 inches from one end of tubular element 14 and the pipe rack can have a length of 20 to 30 feet and an overall height of only 18 to 48 inches.

The upper end of each member 22, i.e. the end that is remote from opening 24, is provided with a recess, or notch, 42 that constitutes a finger grip to aid displacement of member 22 from its retracted position to its stop position. Such displacement requires withdrawal of pin 34 and reinstallation of that pin after member 22 has been brought to its stop position.

Each assembly 20 is associated with a longitudinal slot 44 in the upper surface of element 14 to allow stop member 22 to pivot from its stop position to its retracted position.

Figure 4:
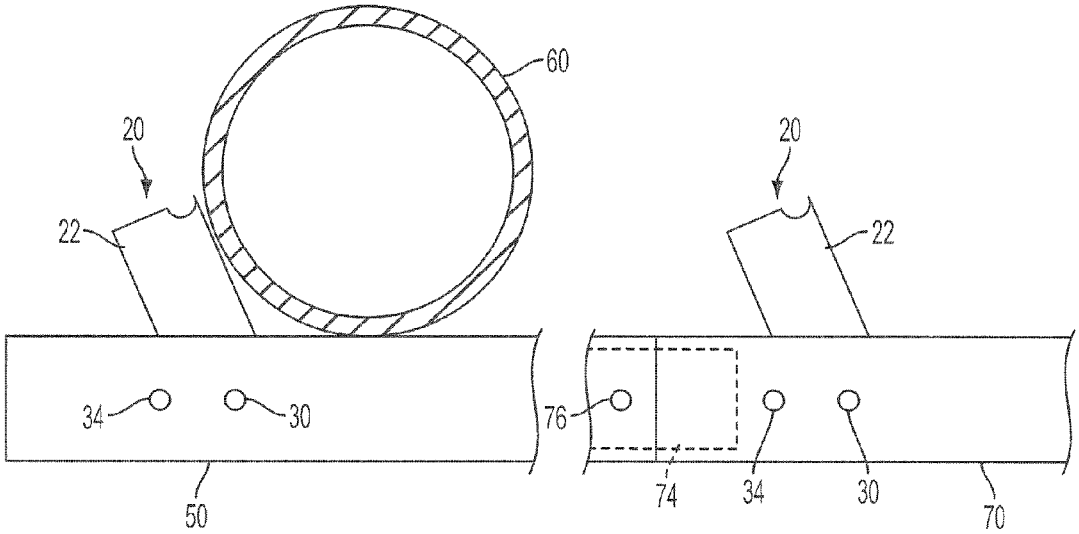
FIG. 4 is an elevational view of a pipe supporting strip according to the invention.

A second component of the invention is shown in FIG. 4. This component is in the form of a metal interlocking safety track, or strip, carrying one or more safety stop assemblies, is shown in FIG. 4, which is a side elevational detail view. This strip includes at least one elongated pipe supporting element in the form of a housing 50, preferably but not necessarily of rectangular cross-section, containing a safety stop assembly 20 having the same structure as shown in FIGS. 2 and 3. Housing 50 is provided on its upper surface with a slot corresponding to slot 44. FIG. 4 also shows a pipe 60 being held in position by stop assembly 20.

Housing 50 may have a length of the order of 5 to 8 feet and may be joined to a further housing 70 that also carries a safety stop assembly 20. Housing 50 and 70 could be identical to one another. In order to join housings 50 and 70 together, housing 70 is provided with two fastening plates 74 that are welded to housing 70 and that have free ends insertable into the end of housing 50. Housing 50 is provided, in its two opposed vertical sides, with through openings 76 that will align with through openings in plates 74 to allow insertion of a pin that will hold housings 50 and 70 together in their assembled condition. Further identical housings can be connected in order to provide a strip having any desired length.

It will be appreciated that, within the framework of this invention, the housings could be fastened together in a wide variety of ways.

An important feature of embodiments of the invention resides in the fact that movement of pipe stop member 22 between its stop position and its retracted position is in a direction away from the pipes being held in place by stop member 22. This assures that movement of stop member 22 to its retracted position is not opposed by the force of a pipe, such as 60, against stop surface 40.

Figure 5:
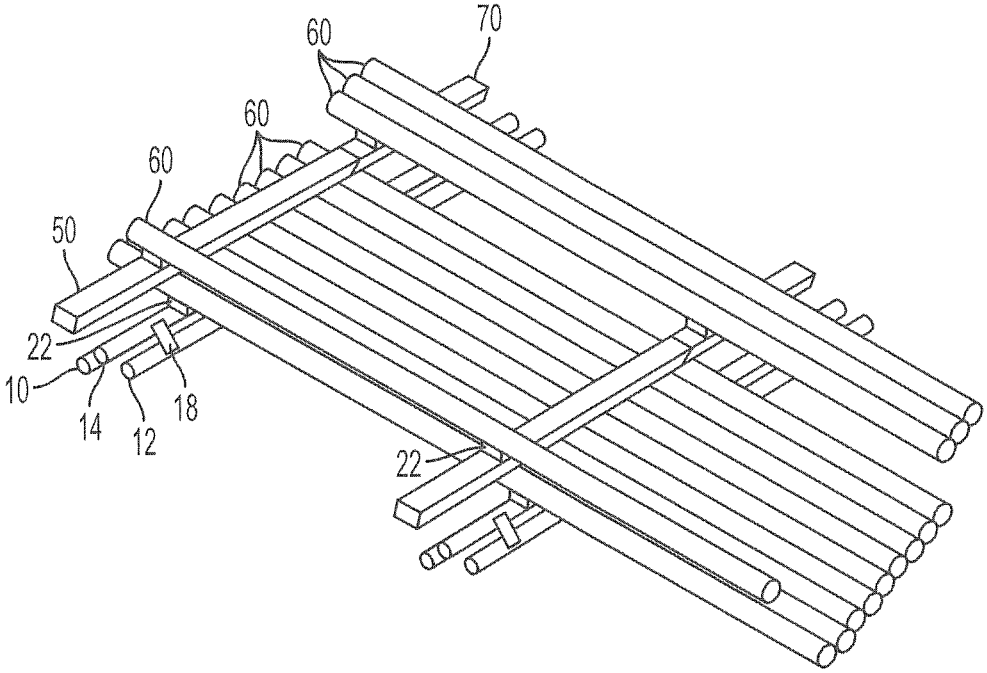
FIG. 5 is a perspective view of a pipe storage system according to the invention employing racks and strips as shown in FIGS. 1-4.

FIG. 5 shows a pipe storage system incorporating features of the present invention. A plurality of racks each having the form shown in FIGS. 1-3 are placed on the ground and a first row of pipes 60 is laid on the racks. Then, a plurality of safety strips each having the form shown in FIG. 4 are then placed on the first layer of pipes, and a second layer of pipes 60 can then be placed on those strips. The stacking of pipes can continue with the addition of further strips and further layers of pipe. When it is desired to roll a pipe off the topmost layer off of the stack, appropriate ones of stop members 22 are moved to their retracted positions, and the pipe can easily be rolled off of the underlying strips or racks, after which members 22 can be returned to their stop positions.

According to a further feature of the invention, the safety strips can be reinforced by inserting pieces of lumber or other rigid materials therein.

Figure 8:
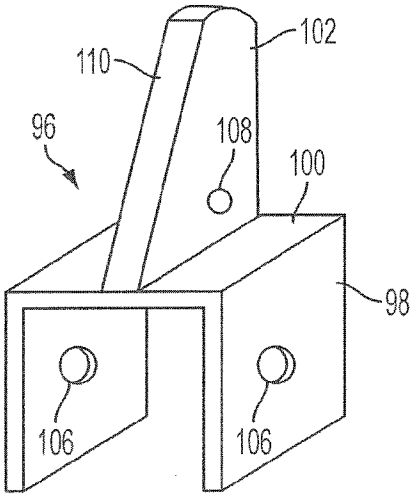
FIG. 8 is a perspective view of a third component of the other embodiment of the pipe supporting strip
Figure 7:
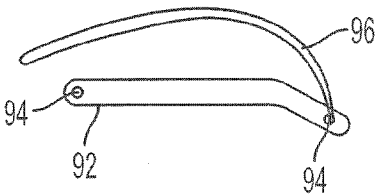
FIG. 7 is a pictorial view of a second component of the other embodiment of the pipe supporting strip.
Figure 6:
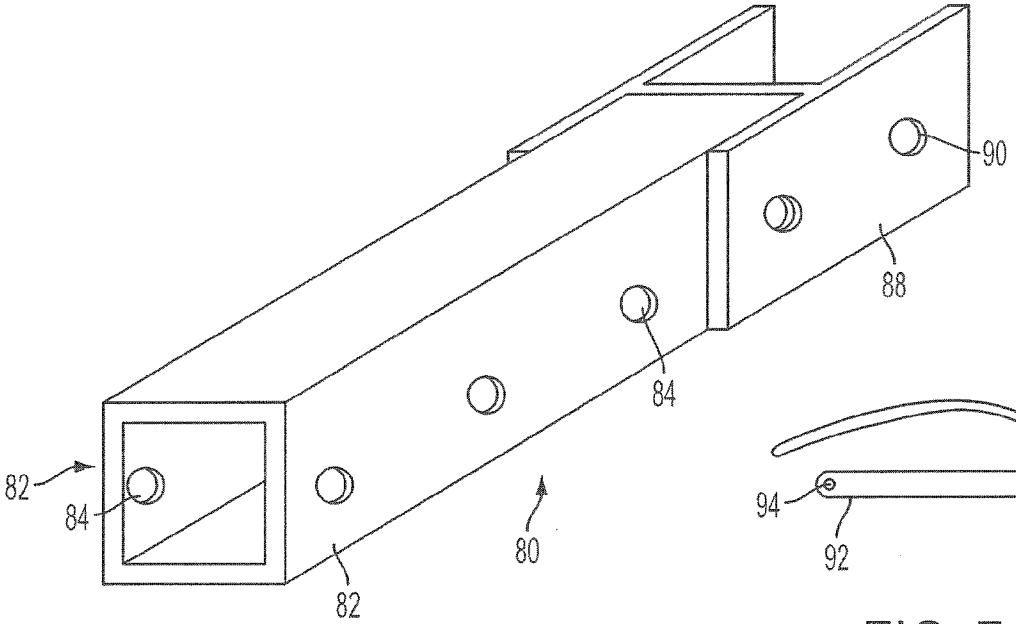
FIG. 6 is a perspective view of one component of another embodiment of a pipe supporting strip according to the invention.

FIGS. 6-8 illustrate several components of another embodiment of a metal interlocking safety track, or strip, according to the invention, including one or more safety stop assemblies. As shown in FIG. 6, this embodiment includes one or more housings, which are hollow and may have a square or rectangular cross-section. Each housing has two opposed side walls 82 and each sidewall is provided with a series of through holes 84. The through holes 84 in one side wall 82 are aligned, along the longitudinal axis of housing 80, with the through holes 84 in the other side wall 82.

When several housings 80 are to be joined together to form an elongated strip, they will placed end-to-end and connected together by a suitable connecting piece such as connecting piece 88.

Connecting piece 88, in the illustrated embodiment, has a generally H-shaped form and is composed of two longitudinally extending side walls joined together by a crosspiece. Each side wall is provided with two through holes 90, the through holes in one side wall being aligned, along the longitudinal direction of the strip, with corresponding through holes in the other side wall.

To assemble two housings 80 together, one end of each housing is introduced into connecting piece 88 so that the housing end abuts against one side of the crosspiece, as shown for one housing 80 in FIG. 6. When thus arranged, one through hole 90 in each wall of piece 88 is aligned with a corresponding through hole 84 in housing 80.

In order to retain the connection between connecting piece 88 and each housing 80, a pin 92, as shown in FIG. 7, will be inserted through the mating through holes 84 and 90 along each side of housing 80. Pin 92 may be provided with two through holes 94 and a cable, cord, or rope, 97 can be initially fastened in one of through holes 94 and can then be secured in place by any suitable means in the other through hole 94 after pin 92 has been inserted into the corresponding through holes 84 and 90.

The safety strip according to this embodiment is completed by a safety stop assembly composed of a pipe stop member 96 and another pin 92, as shown in FIG. 8. Pipe stop member 96 includes a U-shaped attachment part having vertical side walls 98 and a horizontal top wall 100 that joins side walls 98 together. Pipe stop member 96 further includes a pipe stop part 102 that extends upwardly from top wall 100. Parts 98 and 102 are rigidly connected together and may be formed as a one-piece unit.

Each side wall 98 is provided with a through hole 106, the two through holes 106 being aligned with one another along the longitudinal direction of the strip. Stop part 102 is also provided with a through hole 108.

Stop member 96 is placed upon housing 80 at a desired location, with member 96 being oriented so that a pipe to be retained will bear against an inclined stop surface 110 of stop part 102. The stop surface of the stop part forms an obtuse angle with the pipe supporting surface.

Member 96 will be held in place by aligning through holes 106 with a selected pair of through holes 84 and then inserting a pin 92 through holes 84 and 106. Cable 97 may then be threaded through hole 108 and then secured in any suitable manner to the through hole 94 at the leading edge of pin 92.

Pipe stop member 96 could also be dimensioned to be capable of being placed upon connecting part 88, in which case, pin 92 would be inserted through the associated pairs of holes 106, 90 and 84, to hold pipe stop member 96 in place.

Preferably, elements 14, 50, 70 and 80 are positioned so that their pipe supporting surfaces are horizontal. This assures that when safety strip assemblies are retracted or removed to withdraw one pipe, the remaining pipes will not roll off and the stop assemblies can be returned to their stop positions.

This application relates to subject matter disclosed in U. S. Provisional Application No. 60/664,293, filed on Mar. 23, 2005, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A device for supporting a group of pipes during temporary storage, said device comprising:

at least one elongated pipe supporting element having a pipe supporting surface that is substantially horizontal when said device is supporting one or more pipes; and at least one safety stop assembly comprising a pipe stop member and at least one fastening element, wherein:

said pipe stop member is movable relative to said pipe supporting element between a stop position and a withdrawn position;

said pipe stop member, when in the stop position, rests upon said pipe supporting surface and is operative to prevent removal of pipes from said pipe supporting element and, when in the withdrawn position, is operative to allow removal of pipes from said pipe supporting element; and said at least one fastening element is connectable between said pipe supporting element and said pipe stop member for holding said pipe stop member in the stop position, wherein said pipe stop member is removable from said pipe supporting element to place said stop member in the withdrawn position, wherein:

said pipe stop member comprises:

a stop part that is oriented to extend upwardly when said device is in position to support a group of pipes; and an attachment part fixed to said stop part and shaped to fit over said pipe supporting element when said stop member is in the stop position;

said stop part has a pipe stop surface that forms an obtuse angle with said pipe supporting surface;

said pipe stop surface extends in a direction that is inclined to the vertical when said stop member rests on said pipe supporting element;

said pipe stop member, when in the withdrawn position, is removed from said pipe supporting element and, when in the stop position, is held in place relative to said pipe supporting surface only by said fastening element;

said pipe stop member rests on said pipe supporting element when said stop member is in the stop position;

said attachment part comprises two vertical side walls and a horizontal top wall that joins said side walls together;

said vertical side walls straddle said pipe supporting element when said pipe stop member is in the stop position;

each of said vertical side walls is provided with a respective through hole;

said through holes are aligned with one another; and said fastening element is inserted through said through holes to hold said pipe stop member in the stop position.

2. The device of claim 1, wherein said fastening element comprises a pin.

3. The device of claim 2, wherein said pin has two opposed ends, each provide with a respective through hole, and said fastening element further comprises a cable, cord, or rope securable between said through holes at said opposed ends of said pin to maintain said fastening element in place between said pipe supporting element and said pipe stop member when said stop member is in the stop position.

4. The device of claim 2, wherein:

said at least one elongated pipe supporting element comprises at least two elongated pipe supporting elements and at least one fastening member securing said two elongated pipe supporting elements in end-to-end relation so that said pipe supporting surfaces of said pipe supporting elements and said fastening member form a common pipe supporting surface.

5. The device of claim 4, wherein said pipe stop member is dimensioned to rest on said fastening member when in the stop position.

6. The device of claim 5, wherein said fastening member and said pipe supporting elements are provided with through holes to receive said fastening element.

7. A device for supporting a group of pipes during temporary storage, said device comprising:

at least one elongated pipe supporting element having a pipe supporting surface that is substantially horizontal when said device is supporting one or more pipes; and at least one safety stop assembly comprising a pipe stop member and at least one fastening element, wherein:

said pipe stop member is moveable relative to said pipe supporting element between a stop position and a withdrawn position;

said pipe stop member, when in the stop position, rests upon said pipe supporting surface and is operative to prevent removal of pipes from said pipe supporting element and, when in the withdrawn position, is operative to allow removal of pipes from said pipe supporting element; and said at least one fastening element is connectable between said pipe supporting element and said pipe stop member for holding said pipe stop member in the stop position, wherein said pipe stop member is removable from said pipe supporting element to place said stop member in the withdrawn position, wherein:

said at least one elongated pipe supporting element comprises at least two elongated pipe supporting elements and at least one fastening member securing said two elongated pipe supporting elements in end-to-end relation so that said pipe supporting surfaces of said pipe supporting elements and said fastening member form a common pipe supporting surface.

8. The device of claim 7, wherein said pipe stop member is dimensioned to rest on said fastening member when in the stop position.

9. The device of claim 8, wherein said fastening member and said pipe supporting elements are provided with through holes to receive said fastening element.

10. A device for supporting a group of pipes during temporary storage, said device comprising:

at least one elongated pipe supporting element having a pipe supporting surface; and at least one safety stop assembly comprising a pipe stop member and at least one fastening element, wherein:

said pipe stop member is movable relative to said pipe supporting element between a stop position and a withdrawn position;

said pipe stop member, when in the stop position, rests upon said pipe supporting surface and is operative to prevent removal of pipes from said pipe supporting element and, when in the withdrawn position, is operative to allow removal of pipes from said pipe supporting element; and said at least one fastening element is connectable between said pipe supporting element and said pipe stop member for holding said pipe stop member in the stop position, said pipe stop member is removable from said pipe supporting element to place said stop member in the withdrawn position; and said at least one elongated pipe supporting element comprises at least two elongated pipe supporting elements and at least one fastening member securing said two elongated pipe supporting elements in end-to-end relation so that said pipe supporting surface of said pipe supporting elements and said fastening member form a common pipe supporting surface.

11. The device of claim 10, wherein said pipe stop member is dimensioned to rest on said fastening member when in the stop position.

12. The device of claim 11, wherein said fastening member and said pipe supporting elements are provided with through holes to receive said fastening element.

* * * * *